US012398568B2

(12) United States Patent
Mason

(10) Patent No.: US 12,398,568 B2
(45) Date of Patent: Aug. 26, 2025

(54) THERMAL BRICK SUPPORT MOUNTING BRACKET

(71) Applicant: Hohmann & Barnard, Inc., Hauppauge, NY (US)

(72) Inventor: Christopher Mason, Hauppauge, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 168 days.

(21) Appl. No.: 18/306,755

(22) Filed: Apr. 25, 2023

(65) Prior Publication Data

US 2024/0360678 A1 Oct. 31, 2024

(51) Int. Cl.
*E04F 13/08* (2006.01)

(52) U.S. Cl.
CPC ..... *E04F 13/0807* (2013.01); *E04F 13/0853* (2013.01)

(58) Field of Classification Search
CPC ..... E04F 13/0805; E04F 13/0807; E04F 13/0853; E04F 13/0857; E04B 1/4178
USPC ..... 52/562
See application file for complete search history.

(56) References Cited

U.S. PATENT DOCUMENTS

| | | | | |
|---|---|---|---|---|
| 779,268 | A | 1/1905 | Elliott | |
| 1,697,003 | A | 1/1929 | Fink | |
| 2,073,795 | A | 3/1937 | Haugaard | |
| 2,302,920 | A | 11/1942 | Sobie | |
| 2,363,156 | A | 11/1944 | Sinner | |
| 3,050,160 | A | 8/1962 | Chesser | |
| 3,234,702 | A | 2/1966 | Zibell | |
| 3,394,519 | A * | 7/1968 | Tischuk | E04F 13/0814 52/235 |

(Continued)

FOREIGN PATENT DOCUMENTS

| | | |
|---|---|---|
| BE | 1003846 A3 | 6/1992 |
| CA | 1155329 A | 10/1983 |

(Continued)

OTHER PUBLICATIONS

IG Steel Lintels Masonry Support & Windpost Systems, Wayback Machine, Aug. 18, 2013, pp. 1-36.

(Continued)

*Primary Examiner* — Christine T Cajilig
(74) *Attorney, Agent, or Firm* — Andrus Intellectual Property Law, LLP

(57) ABSTRACT

A thermal brick support system includes a mounting bracket and a shelf. The mounting bracket has a mounting plate and a pair of spaced apart legs extending from the mounting bracket. The legs extend perpendicular from the mounting plate and each have an extension portion extending from the mounting plate and a depending portion depending from the extension portion. The extension portion spaces the depending portion from a plane defined by the mounting plate to define a gap. The legs each have a hook formed therein on a front edge. The shelf has an upstanding leg and a transverse leg. The upstanding leg has through wall slots formed therein to cooperate with the mounting bracket hooks. When the shelf is positioned on the mounting bracket, the hooks engage the slots to support the shelf from the mounting bracket. A mounting bracket for a thermal brick support system is also disclosed.

17 Claims, 3 Drawing Sheets

(56) References Cited

U.S. PATENT DOCUMENTS

| | | | | |
|---|---|---|---|---|
| 3,414,224 | A | 12/1968 | Robilliard | |
| 3,450,427 | A | 6/1969 | Fischer | |
| 3,680,271 | A | 8/1972 | Satchell | |
| 3,942,292 | A | 3/1976 | Robinson | |
| 4,013,253 | A | 3/1977 | Perrault | |
| 4,390,103 | A | 6/1983 | Husband | |
| 4,515,494 | A | 5/1985 | Robilliard | |
| 4,805,364 | A | 2/1989 | Smolik | |
| 4,827,684 | A | 5/1989 | Allan | |
| 4,869,043 | A | 9/1989 | Hatzinikolas | |
| 5,035,099 | A | 7/1991 | Lapish | |
| 5,063,715 | A | 11/1991 | Goodman | |
| 5,082,388 | A | 1/1992 | Lauterbach | |
| 5,236,625 | A | 8/1993 | Bardo | |
| 5,265,396 | A | 11/1993 | Amimoto | |
| 5,313,752 | A | 5/1994 | Hatzinikolas | |
| 5,392,581 | A | 2/1995 | Hatzinikolas | |
| 5,619,834 | A | 4/1997 | Chen | |
| 5,720,571 | A | 2/1998 | Frobosilo | |
| 5,816,008 | A | 10/1998 | Hohmann | |
| 6,109,461 | A | 8/2000 | Kluge | |
| 6,128,883 | A | 10/2000 | Hatzinikolas | |
| 6,161,709 | A | 12/2000 | Kluge | |
| 6,212,841 | B1 | 4/2001 | Plume | |
| 6,298,620 | B1 | 10/2001 | Hatzinikolas | |
| 6,397,552 | B1 | 6/2002 | Bourque | |
| 6,584,741 | B1 | 7/2003 | Hatzinikolas | |
| 6,973,756 | B2 | 12/2005 | Hatzinikolas | |
| D550,540 | S | 9/2007 | Nawrocki | |
| 7,367,165 | B2 | 5/2008 | Hatzinikolas | |
| 7,392,911 | B2 | 7/2008 | Stitchick | |
| 7,415,803 | B2 | 8/2008 | Bronner | |
| 7,469,659 | B2 | 12/2008 | De Jonge | |
| 7,654,058 | B2 | 2/2010 | Hatzinikolas | |
| 7,908,804 | B2 | 3/2011 | Vieira | |
| 8,051,621 | B2 | 11/2011 | Hatzinikolas | |
| 8,117,785 | B2 | 2/2012 | Teichner | |
| 8,333,048 | B2 | 12/2012 | Talpe | |
| 8,490,340 | B2 | 7/2013 | Hatzinikolas | |
| 8,490,341 | B2 | 7/2013 | Hatzinikolas | |
| 8,511,032 | B2 | 8/2013 | Abdel-Rahman | |
| 8,516,763 | B2 | 8/2013 | Hohmann, Jr. | |
| 8,555,595 | B2 | 10/2013 | Hatzinikolas | |
| 8,621,802 | B2 | 1/2014 | Spyrou | |
| 8,667,763 | B2 | 3/2014 | Hatzinikolas | |
| 8,893,452 | B2 | 11/2014 | Hatzinikolas | |
| 8,955,263 | B2 | 2/2015 | Hatzinikolas | |
| 9,010,050 | B2 | 4/2015 | Hatzinikolas | |
| 9,010,062 | B2 | 4/2015 | Hill | |
| 9,027,301 | B2 | 5/2015 | Guinn | |
| 9,234,344 | B2 | 1/2016 | Hatzinikolas | |
| 9,316,004 | B1 | 4/2016 | Hatzinikolas | |
| 9,447,585 | B2 | 9/2016 | Hatzinikolas | |
| 10,294,676 | B2 | 5/2019 | Hatzinikolas | |
| 10,323,419 | B2 | 6/2019 | Hatzinikolas | |
| 11,118,358 | B2 * | 9/2021 | Hatzinikolas | E04F 13/0857 |
| 11,255,091 | B2 * | 2/2022 | Hatzinikolas | E04F 13/142 |
| 2004/0221535 | A1 | 11/2004 | Hatzinikolas | |
| 2005/0246987 | A1 | 11/2005 | Hatzinikolas | |
| 2006/0053743 | A1 | 3/2006 | Hatzinikolas | |
| 2006/0272251 | A1 | 12/2006 | Hatzinikolas | |
| 2008/0098681 | A1 | 5/2008 | Hatzinikolas | |
| 2010/0088992 | A1 | 4/2010 | Hatzinikolas | |
| 2010/0287864 | A1 | 11/2010 | Hatzinikolas | |
| 2010/0287865 | A1 | 11/2010 | Hatzinikolas | |
| 2011/0061337 | A1 | 3/2011 | O'Shea | |
| 2012/0005981 | A1 | 1/2012 | Hatzinikolas | |
| 2012/0125646 | A1 | 5/2012 | Hatzinikolas | |
| 2012/0192504 | A1 | 8/2012 | Hatzinikolas | |
| 2012/0279143 | A1 | 11/2012 | Hatzinikolas | |
| 2014/0150373 | A1 | 6/2014 | Hatzinikolas | |
| 2014/0174014 | A1 | 6/2014 | Hatzinikolas | |
| 2014/0190110 | A1 | 7/2014 | Hatzinikolas | |
| 2015/0059259 | A1 | 3/2015 | Hatzinikolas | |
| 2016/0201314 | A1 | 7/2016 | Hatzinikolas | |
| 2016/0305113 | A1 | 10/2016 | Hatzinikolas | |
| 2017/0284104 | A1 | 10/2017 | Hatzinikolas | |
| 2019/0024381 | A1 | 1/2019 | Hatzinikolas | |
| 2020/0190814 | A1 * | 6/2020 | Hatzinikolas | E04F 13/0853 |
| 2020/0318341 | A1 | 10/2020 | Jablonsky | |
| 2022/0396948 | A1 * | 12/2022 | Hatzinikolas | E04F 13/25 |

FOREIGN PATENT DOCUMENTS

| | | | | |
|---|---|---|---|---|
| CA | 1251336 | A | 3/1989 | |
| CA | 1294457 | C | 1/1992 | |
| CA | 2034085 | A1 | 7/1992 | |
| CA | 2102297 | A1 | 5/1995 | |
| CA | 2249509 | A1 | 4/2000 | |
| CA | 2254510 | A1 | 5/2000 | |
| CA | 2284069 | A1 | 5/2000 | |
| CA | 2591687 | A1 | 5/2000 | |
| CA | 2759747 | A1 | 5/2000 | |
| CA | 2759778 | A1 | 5/2000 | |
| CA | 2759837 | A1 | 5/2000 | |
| CA | 2518030 | A1 | 3/2007 | |
| CA | 2700636 | A1 | 4/2008 | |
| CA | 2738488 | A1 | 11/2012 | |
| CA | 2769821 | A1 | 8/2013 | |
| CA | 2865824 | A1 | 9/2013 | |
| CA | 2804542 | A1 | 6/2014 | |
| CA | 2872778 | A1 | 6/2016 | |
| CA | 2872780 | A1 | 6/2016 | |
| CA | 2888404 | A1 | 10/2016 | |
| DE | 7714716 | U1 | 9/1977 | |
| DE | 3239161 | A1 | 5/1983 | |
| DE | 3910286 | A1 | 10/1990 | |
| DE | 4441051 | A1 | 5/1996 | |
| DE | 10117199 | A1 * | 10/2002 | E04F 13/0855 |
| DE | 202007016115 | U1 | 4/2009 | |
| DE | 102010015262 | A1 * | 10/2011 | E04F 13/0853 |
| EP | 0566829 | A1 | 10/1993 | |
| EP | 0869232 | A1 | 10/1998 | |
| EP | 1211364 | A2 | 6/2002 | |
| EP | 1353021 | A1 | 10/2003 | |
| EP | 1375777 | A1 | 1/2004 | |
| EP | 2143853 | A2 * | 1/2010 | E04F 13/0805 |
| EP | 2397622 | A1 | 12/2011 | |
| FR | 2738025 | A1 | 2/1997 | |
| GB | 2062058 | A | 5/1981 | |
| GB | 2263918 | A | 8/1993 | |
| GB | 2288831 | A | 11/1995 | |
| GB | 2289906 | A | 12/1995 | |
| GB | 2316103 | A | 2/1998 | |
| GB | 2375552 | A | 11/2002 | |
| GB | 2417039 | A | 2/2006 | |
| GB | 2443262 | A | 4/2008 | |
| GB | 2505980 | A | 3/2014 | |
| IE | 20130144 | A1 | 11/2013 | |
| KR | 20050121764 | A | 12/2005 | |
| WO | 0131135 | A1 | 5/2001 | |
| WO | 2019014740 | A1 | 1/2019 | |

OTHER PUBLICATIONS

Fero Fast Angle Support Technology, Wayback Machine, Mar. 17, 2012, pp. 1-4.
Bespoke Bracket Angle Support, Ancon Ltd, pp. 1-6.
Non-Welded Bracket Angle Support, Ancon Ltd, pp. 1-5.
"Mortar Collection Systems," HB Mortar Trap tm with CMU Detail, 1 page.

* cited by examiner

THERMAL BRICK SUPPORT MOUNTING BRACKET

BACKGROUND

The present disclosure relates to an improved mounting bracket, and more particularly, to a mounting bracket for a thermal brick support system.

Brick support systems for building are known. In one such system, a shelf is mounted to struts that are mounted to the building substrate. As such, the brackets rest on the substrate. The shelf is mounted to elongated brackets that are affixed to inserts in the substrate. The brackets have legs that extend outward to which the shelves are mounted. The system thus allows for mounting the shelf and the brick spaced from the substate to accommodate insulation, vapor barriers and air gaps.

While such a system functions well for supporting and installing the brick façade, it can form a thermal bridge between the environs and the substrate. Such as thermal bridge allows for heat and cooling losses within the structure.

Accordingly, there is a need for a brick support system that reduces thermal losses from the substrate and structure. Desirably, such a system reduces thermal bridging. More desirably still, such a system allows for sufficient space between the brick and substrate to accommodate insulation, vapor barriers and air gaps.

SUMMARY

Various embodiments of the present disclosure provide a thermal brick support system. The system includes a mounting bracket having a mounting plate and a pair of spaced apart legs extending from the mounting bracket. The legs extend perpendicular from the mounting plate, and each have an extension portion extending from the mounting plate and a depending portion depending from the extension portion. The extension portion spaces the depending portion from a plane defined by the mounting plate to define a gap. The legs each have a hook formed therein on a front edge thereof. In embodiments, the only connection between the legs is the mounting plate. The mounting bracket can be formed as unitary member.

A shelf has an upstanding leg and a transverse leg. The upstanding leg has through wall slots formed therein to cooperate with the mounting bracket hooks. When the shelf is positioned on the mounting bracket, the hooks engage the slots to support the shelf from the mounting bracket.

In embodiments, the hooks have an upwardly extending finger to secure the shelf on the mounting bracket. The hooks are formed on the front edge between an upper edge of the legs and a lower edge of the legs.

The mounting plate can further include an opening therein. The opening can be a slotted opening.

In embodiments, the mounting plate has a height and the legs have an overall height, and the height of the mounting plate is less than the overall height of the legs. The height of the mounting plate can be less than or equal to about ½ of the overall height of the legs. The height of the mounting plate can be about 40% to 50% of the overall height of the legs.

In embodiments, a depth of the mounting bracket is about 6¼ inches, a depth of the depending portion is about 5 inches and the gap is about 1¼ inches.

In another aspect, a mounting bracket for a thermal brick support system for securing the system to a wall, includes a mounting plate that defines a plane and a pair of spaced apart legs extending from the mounting bracket. The legs extend perpendicular from the mounting plate and each have an extension portion extending from the mounting plate and a depending portion depending from the extension portion. The extension portion spaces the depending portion from a plane defined by the mounting plate to define a gap. The only connection between the legs is the mounting plate.

The legs each have a hook formed therein on a front edge. When the mounting bracket is secured to the wall the depending portion is spaced from the plane defined by the mounting plate to define a gap between the depending portion and the wall.

In embodiments, the mounting plate has a height and the legs have an overall height, and the height of the mounting plate is less than the overall height of the legs. The height of the mounting plate can be less than or equal to about ½ of the overall height of the legs, and can be about 40% to 50% of the overall height of the legs.

Other aspects, objectives and advantages will become more apparent from the following detailed description when taken in conjunction with the accompanying drawings.

DETAILED DESCRIPTION

While the present disclosure is susceptible of embodiments in various forms, there is described presently preferred embodiments with the understanding that the present disclosure is to be considered an exemplification and is not intended to limit the disclosure to the specific embodiments illustrated.

Figure 1:
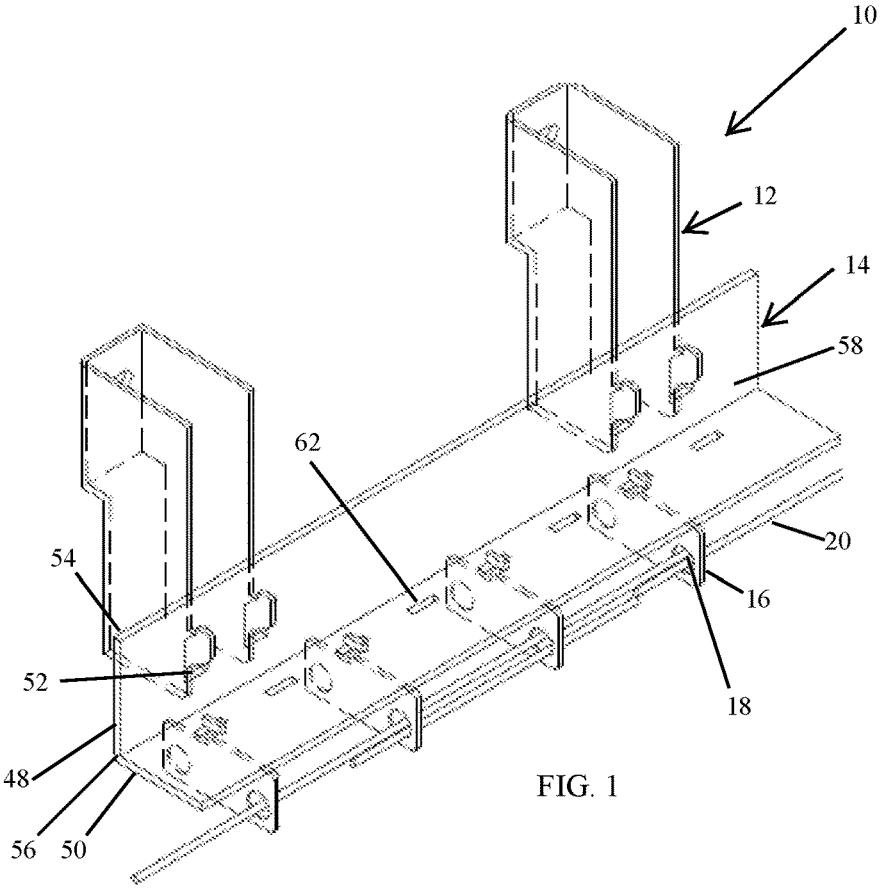
FIG. 1 is a perspective view of an embodiment of a thermal brick support system.

Referring now to the figures and in particular to FIG. 1, there is shown an embodiment of a thermal brick support system 10. The support system 10 includes a mounting bracket 12 and a shelf 14 supported on the mounting bracket 12. The system 10 may also include overhead brick support members 16 having openings 18 therein and wires 20 for threading through the overhead members' openings 18 to support the bricks B. The mounting bracket 12 can be mounted to a structural form, such as a slab edge, steel beam, bond beam or the like. Other mounting arrangements will be understood by those skilled in the art. All such mounting arrangements are referred to collectively as wall, substrate, or wall or substrate and all sch mounting arrangements are with the scope and spirit of the present disclosure.

Figure 2:
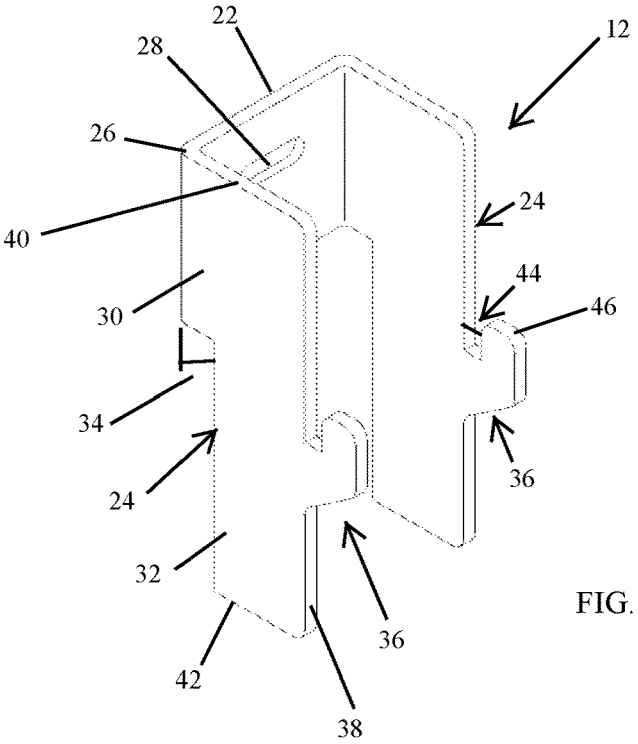
FIG. 2 is a perspective view of an embodiment of a mounting bracket for the thermal brick support system.
Figure 3A:
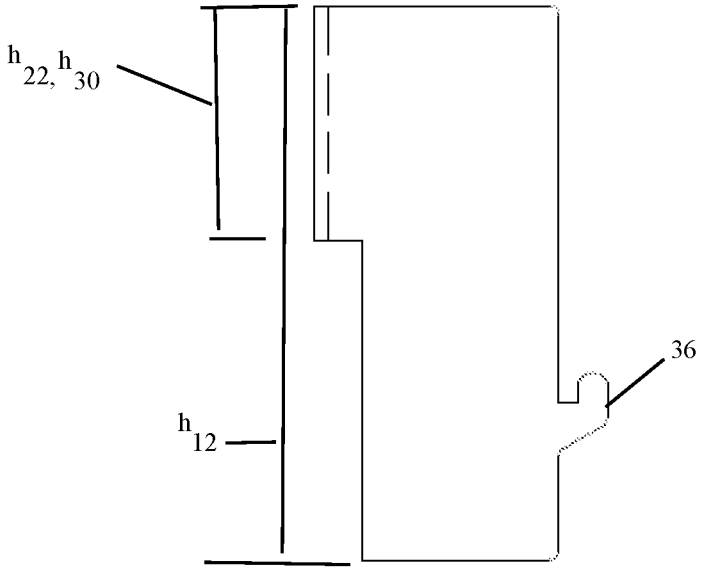
FIGS. 3A and 3B are side and front views of the mounting bracket of FIG. 2.
Figure 3B:
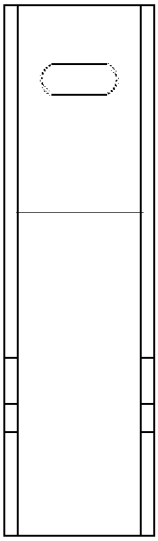

Referring now to FIGS. 2, 3A and 3B, the mounting bracket 12 includes a mounting plate 22, and a pair of legs 24 extending from opposing ends 26 of the mounting plate 22. An opening 28 in the mounting plate 22 is configured to receive a fastener F to fasten the mounting bracket 12 to the wall or substrate S. In embodiments, the opening 28 is a slotted opening. The mounting plate 22 defines a plane $P_{22}$.

In a current embodiment, the legs 24 extend about perpendicular from the mounting plate 22. The legs 24 each include an extension portion 30 extending from the mounting plate 22 and a depending portion 32 extending downwardly or depending from the extension portion 30. The extension portion 30 has a height $h_{30}$ equal to the height $h_{22}$ of the mounting plate 22. That is, there is no rear wall of the depending portion 32. The only rear wall is the mounting plate 22, and the mounting plate 22 is the only connection between the legs 24.

The extension portion 30 is configured to space the depending portion 32 from the mounting plate plane $P_{22}$ to define a gap 34 between the depending portion 32 and the wall or substrate S. In a current embodiment, the mounting plate 22 minimizes the surface area of the mounting bracket 12 that is in contact with the wall or substrate S and the extension portion 30 spaces the depending portion 32 from the wall or substrate S to minimize the thermal bridge between the mounting bracket 12 and the wall or substrate S and thus the building structure. In embodiments, the mounting bracket 12 is a unitary member.

Upwardly extending hooks are 36 formed on a front edge 38 of the depending portions 32 of each of the legs 24 between an upper edge 40 of the legs 24 and a lower edge 42 of the legs 24. A space 44 is formed between an upwardly oriented finger 46 at the end of each hook 36 and the depending portion 32 of its leg 24.

Figure 4:
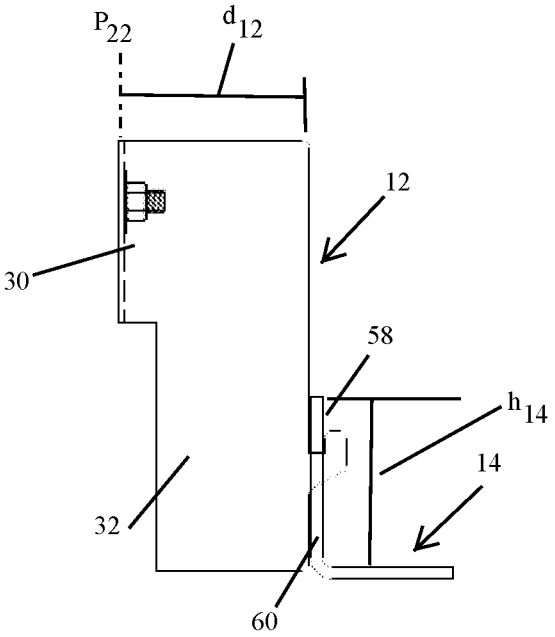
FIG. 4 is a side view similar to FIG. 3A showing a brick support shelf mounted to the mounting bracket.

Referring now to FIGS. 1 and 4, the shelf 14 is a formed as an L or angle having an upstanding leg 48 and a transverse leg 50. The upstanding leg 48 includes through wall slots 52 formed between upper and lower edges 54, 56 of the upstanding leg 48. The slots 52 are configured to cooperate with the depending portion hooks 36. When the shelf 14 is positioned on the mounting brackets 12, the hooks 36 are inserted into the slots 52 and the fingers 46 rest on an inner wall 58 of the upstanding legs 48, above the slots 52. A lower portion 60 of the upstanding leg 48, below the slots 52, rests on the portion of the mounting bracket below the hooks 36. This provides stability of the shelf 14 as positioned on the mounting bracket 12.

The shelf transverse leg 50 includes slots 62 formed therein. The slots 62 are configured to receive tabs 64 on the overhead brick support members 16.

In a current embodiment the overall height $h_{12}$ of the mounting bracket 12 is about 14.125 (14⅛) inches and the height $h_{22}$ of the mounting plate 22 is about 6 inches or about 42.5 percent of the mounting bracket overall height $h_{12}$. The gap or space 34 between the depending portion 32 and the rear of the mounting plate 22 or the wall or substrate S is about 1.25 (1¼) inches. The overall depth $d_{12}$ of the mounting bracket 12, exclusive of the hook 36 is about 6.25 (6¼) inches. The overall height $h_{14}$ of the shelf 14 is about 6 inches and the depth $d_{14}$ of the shelf 14 is about 4.75 (4¾) inches. The hook 36 extends from the leg depending portion 32 about 1.25 (1¼) inches and the space 44 between the interior wall of the hook 36 and the front edge 38 of the depending portion 32 (to receive the shelf 14) is about 0.5 (½) inch.

When the shelf 14 is installed on the mounting bracket 12, the shelf 14 extends slightly below the depending leg lower edge 42. In a current embodiment the shelf 14 extends about 0.25 (¼) inch below the lower edge 42.

Figure 5:
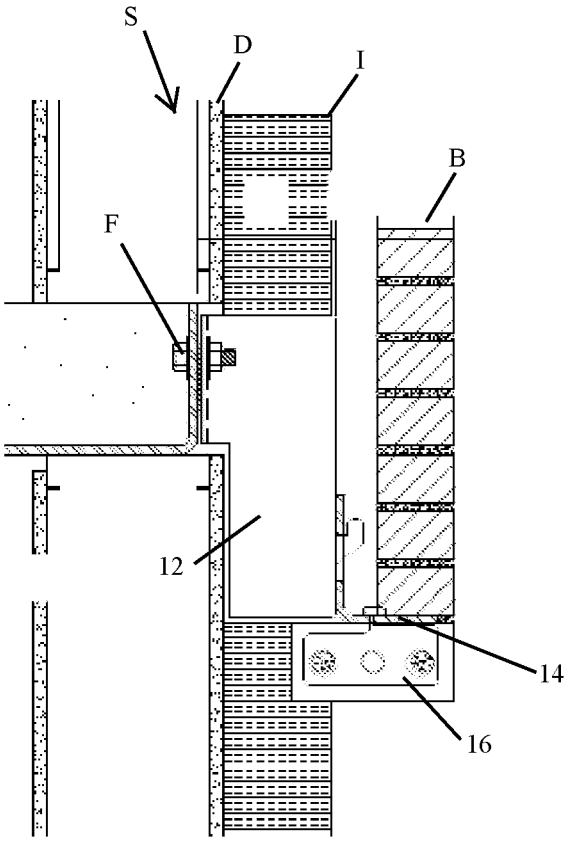
FIG. 5 is a sectional view showing the support system with the mounting bracket mounted to a wall or substrate and having brick courses supported by the system.
Figure 6:
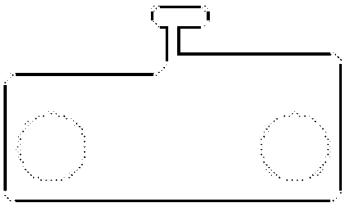
FIG. 6 is a side view of an embodiment of a brick overhead support member.

Referring now to FIG. 5, there is shown a sectional view of an example of a wall S having the thermal brick support system 10 mounted thereto and a number of courses of bricks B on the support system 10. The mounting bracket 12 is mounted to the wall S by fasteners F, such as bolts. In the illustrated wall S, the mounting bracket 12 is mounted to a steel member. Insulation I is positioned around, above, below and between the mounting brackets 12 and in the space between the mounting bracket depending leg portions 32 and the wall S. A vapor barrier (not shown) can be installed over the insulation I and mounting brackets 12, including the mounting bracket legs 24, and the brick B installed over the vapor barrier. Other members, such as backing board D, condensation and waterproof barriers/films and the like may be installed as desired.

It will be appreciated that the present thermal brick support system 10 provides advantages over known brick support systems. For example, the present system 10 allows for the installation of brick B on a wall or substrate S to include insulation I, a backing board D, a vapor barrier and an air gap between the brick B and the wall S. In addition, the present system 10 minimizes the thermal bridge created by contact of the steel members of the support system 10 (which is only the mounting plate 22) with the wall or substrate S by reducing the surface area of the mounting bracket 12 that is in contact with the wall or substate S. In addition, the present system 10 facilitates ready installation of brick B on the wall or substrate S using readily installed mounting brackets 12 with a hook 36 and slot 52 mounting configuration.

It will be appreciated that the dimensions of the support system 10 and its components are examples only and that the system 10 and its components can have other dimensions as desired or required for a particular design or installation.

In the present disclosure, the words "a" or "an" are to be taken to include both the singular and the plural. Conversely, any reference to plural items shall, where appropriate, include the singular. All percentages are percentages by weight, unless otherwise noted.

All patents and published applications referred to herein are incorporated by reference in their entirety, whether or not specifically done so within the text of this disclosure.

It will also be appreciated by those skilled in the art that the relative directional terms such as sides, upper, lower, top, bottom, rearward, forward and the like are for explanatory purposes only and are not intended to limit the scope of the disclosure.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A thermal brick support system, comprising:

a mounting bracket having a mounting plate and a pair of spaced apart legs extending from the mounting bracket, the legs extending perpendicular from the mounting plate, the legs each having a front edge opposite the mounting plate, an extension portion extending from the mounting plate and a depending portion depending from the extension portion, the extension portion extending between an upper edge and an extension edge with the depending portion extending away from the upper edge past the extension edge to a lower edge of the depending portion, the depending portion having a rear edge opposite the front edge and the extension edge spacing the depending portion from a plane defined by the mounting plate to define a gap between the plane and the rear edge, the legs each having a hook formed on the front edge at a position between the extension edge and the lower edge of the depending portion and extending away from the front edge;

a shelf having an upstanding leg and a transverse leg, the upstanding leg having an upper edge, an inner wall surface on an included angle side of the shelf, and the upstanding leg having an outer wall surface opposite the inner wall surface and wall slots formed in the upstanding leg and configured to receive the mounting bracket hooks, wherein when the shelf is positioned on the mounting bracket, the hooks of the mounting bracket extend through the wall slots such that the outer wall surface of the shelf engages the front edge of the leg to support the shelf from the mounting bracket, with the upper edge at a position between the extension edge and the lower edge of the depending portion.

2. The system of claim 1, wherein the hooks have an upwardly extending finger defining an interior finger surface spaced apart from the front edge and the interior finger surface is configured to engage the interior wall surface of the upstanding leg to retain the shelf on the mounting bracket.

3. The system of claim 1, wherein the mounting plate further includes an opening therein.

4. The system of claim 3, wherein the opening is a slotted opening.

5. The system of claim 1, wherein the height of the mounting plate is less than or equal to about ½ of the overall height of the legs.

6. The system of claim 5, wherein the height of the mounting plate is about 40% to 50% of the overall height of the legs.

7. The system of claim 1, wherein a depth of the mounting bracket is about 6-¼ inches, a depth of the depending portion is about 5 inches and the gap is about 1¼ inches.

8. The system of claim 1, wherein the mounting bracket is a unitary member.

9. A mounting bracket for a thermal brick support system for securing the system to a wall, the mounting bracket comprising:

a mounting plate defining a plane; and a pair of spaced apart legs extending from the mounting bracket, the legs extending perpendicular from the mounting plate, the legs each having a front edge opposite the mounting plate, an extension portion extending from the mounting plate and a depending portion depending from the extension portion, the extension portion extending between an upper edge and an extension edge with the depending portion extending away from the upper edge past the extension edge to a lower edge of the depending portion, the depending portion having a rear edge opposite the front edge and the extension edge spacing the depending portion from the plane defined by the mounting plate to define a gap between the plane and the rear edge, the legs each having a hook formed on the front edge at a position between the extension edge and the lower edge of the depending portion and extending away from the front edge.

10. The mounting bracket of claim 9, wherein the mounting plate has a height and wherein the legs have an overall height, and wherein the height of the mounting plate is less than the overall height of the legs.

11. The mounting bracket of claim 10, wherein the height of the mounting plate is less than or equal to about ½ of the overall height of the legs.

12. The mounting bracket of claim 11, wherein the height of the mounting plate is about 40% to 50% of the overall height of the legs.

13. The system of claim 1, further comprising an overhead brick support member comprising a plate defining at least one opening therethrough, the at least one opening configured to receive at least one wire, the overhead brick support member depending from the transverse leg of the shelf.

14. The system of claim 13, wherein the overhead brick support member comprises a tab extending therefrom and the transverse leg of the shelf comprises a slot configured to receive the tab of the overhead brick support member.

15. The system of claim 14, wherein the tab of the overhead brick support member is a tee and the slot is oriented orthogonally to a final position of the overhead brick support member and configured to receive the tab therethrough wherein upon subsequent rotation, the tab an overhead brick support member is retained in the final position by the transverse leg of the shelf.

16. The system of claim 1, further comprising:

an overhead brick support member comprising a plate defining at least one opening therethrough, and a tee shaped tab extending from the plate, wherein the tab is configured to be received within slot oriented parallel to the upstanding leg of the shelf, and the tab retains the overhead brick support member from the transverse leg in an orientation orthogonal to the transverse leg and the upstanding leg; and at least one wire received through the at least one opening in the overhead brick support member.

17. A thermal brick support system, comprising:

a mounting bracket having a mounting plate and a pair of spaced apart legs extending from the mounting bracket, the legs extending perpendicular from the mounting plate, the legs each having an extension portion extending from the mounting plate and a depending portion depending from the extension portion, the extension portion spacing the depending portion from a plane defined by the mounting plate to define a gap, the legs each having a hook formed therein on a front edge thereof; and a shelf having an upstanding leg and a transverse leg, the upstanding leg having through wall slots formed therein to cooperate with the mounting bracket hooks, wherein when the shelf is positioned on the mounting bracket, the hooks engage the slots to support the shelf from the mounting bracket;

wherein a depth of the mounting bracket is about 6¼ inches, a depth of the depending portion is about 5 inches and the gap is about 1¼ inches.

* * * * *